US005424607A

United States Patent [19]

Jeong

[11] Patent Number: 5,424,607

[45] Date of Patent: Jun. 13, 1995

[54] FLUORESCENT DISPLAY DEVICE

[75] Inventor: Dae-cheol Jeong, Kyungsangnam-do, Rep. of Korea

[73] Assignee: Samsung Display Devices Co., Ltd., Kyungki-Do, Rep. of Korea

[21] Appl. No.: 156,645

[22] Filed: Nov. 24, 1993

[30] Foreign Application Priority Data

Nov. 24, 1992 [KR] Rep. of Korea ..... 92-23167

[51] Int. Cl.[6] ..... H01J 1/88

[52] U.S. Cl. ..... 313/496; 313/495; 313/497; 313/513; 313/272; 313/271

[58] Field of Search ..... 313/495, 496, 497, 513, 313/271, 272; 29/760; 248/225.1, 172, 916

[56] References Cited

U.S. PATENT DOCUMENTS

| | | | |
|---|---|---|---|
| 4,612,740 | 9/1986 | Yamamoto | 248/225.1 |
| 4,613,135 | 9/1986 | Rush | 248/225.1 X |
| 4,788,472 | 11/1988 | Katakami | 313/496 |

FOREIGN PATENT DOCUMENTS

| | | | |
|---|---|---|---|
| 56-50039 | 5/1981 | Japan | 313/496 |
| 3-10722 | 1/1991 | Japan | 29/760 |

OTHER PUBLICATIONS

RCA Technical Notes: TN No. 1345; "Semi-Universal Chip Carrier Package Holding Fixture for Branding"; Apr. 12, 1984.

*Primary Examiner*—Donald J. Yusko
*Assistant Examiner*—N. D. Patel
*Attorney, Agent, or Firm*—Leydig, Voit & Mayer

[57] ABSTRACT

A fluorescent display device includes a substrate having a pattern display thereon, at least one pair of conductive bases, the bases being separated by a predetermined interval and facing each other in parallel on the substrate, the conductive bases each having at least one pair of position-setting holes perpendicular to the substrate; and at least one pair of supporters, each of which includes a fixing portion having at least one pair of position-setting holes corresponding to the position-setting holes of one of the bases, and a supporting portion extending from said fixing portion, one of the position-setting holes in each of the supporters being a slot. The slots correspond to a hole in a supporter so that it is unnecessary for the base specifications to be changed even in the event of variation of the intervals between the position-setting holes in the supporters.

6 Claims, 2 Drawing Sheets

FLUORESCENT DISPLAY DEVICE

BACKGROUND OF THE INVENTION

The present invention relates to a fluorescent display device and, more particularly, to a fluorescent display device with an improved structural relationship between a filament supporter and a base.

A fluorescent display device for use in display devices for digital measuring instruments, telephones, communications apparatus, etc., is constructed as shown in FIG. 1.

Here, a signal line 2 composed of a conductive metal such as aluminum (A1), is disposed on a glass substrate 1 that defines a vacuum vessel together with cover plate 1*a*, and an insulation layer 3 is disposed on signal line 2 for the protection thereof. Conductive segment layers 4 are disposed on insulation layer 3 in a predetermined pattern, and a fluorescent layer 5 is disposed each conductive segment layer 4. Through-holes 3*a* are arranged below conductive layer 4 so that conductive layer 4 and signal line 2 are electrically connected via through-holes 3*a*. Moreover, a grid 7 for controlling thermopic flow and filaments 6 for emitting thermal electrons are installed at different levels above fluorescent layer 5.

FIG. 2 is a schematic, perspective view showing the conventional fluorescent display device having filaments 6 shown in FIG. 1. Two bases 9 of a predetermined width are secured opposite ends of substrate 1 spaced from each other by a predetermined interval, and each supporter 8 to which filaments 6 are welded and secured is welded to one of the bases 9. Supporters 8 and bases 9 have position-setting holes 8*a* and 9*a* for setting the exact positions for welding. Also, substrate 1 has position-setting patterns corresponding to position-setting holes 9*a* of the bases 9.

In the conventional fluorescent display devices constructed as above, the interval between the two bases is of most importance in supplying the filaments with uniform tension. Accordingly, when manufacturing a fluorescent display device, the filament length should be determined according to the interval between the two supporters. Therefore, if the two supporters fixed on the base are not kept parallel, or the interval is greatly different from the predetermined interval, the tension of filaments is insufficient or excessive. When the substantial tension of the filaments is lower than the predetermined tension, the filaments are not pulled tight, but droop towards the substrate. On the contrary, if the tension of filaments greatly exceeds the predetermined tension requirement, the filaments impose an excessive load on the supporters, so that the supporters may be deformed.

To overcome the problems due to the improper interval between the supporters, position-setting holes are arranged on the bases and the supporters, for their exact matching. In the conventional fluorescent display devices, as described above. since the position-setting holes are located at exact positions on the supporters and bases for the consistency therebetween, a variation in supporter size leads to a change of the size of the bases. Further, position-setting holes to be formed on the bases and supporters must be consistent with one another.

The fluorescent display device as described above has a disadvantage in that the supporters and bases have a limited application range. That is, a variety of supporters of different sizes (also having different intervals between position-setting holes) cannot be secured onto a base of any particular size. Therefore, the supporters of a particular specification and corresponding bases should be corelated.

Therefore, due to the above requirements, the bases and supporters of a particular specification must provided in correspondence with the specification of the fluorescent display device, which is cumbersome.

SUMMARY OF THE INVENTION

It is an object of the present invention to provide a fluorescent display device having a supporting structure for wide use between its supporters and bases.

It is another object of the present invention to provide a fluorescent display device comprised of commonly used components and thereby capable of being manufactured easily.

To achieve the objects, the present invention provides a fluorescent display device comprising a substrate on which a predetermined pattern display portion is formed, the pattern display portion including a fluorescent layer, a segment layer and a signal line; at least one pair of conductive bases arranged to be separated by a predetermined interval and to face each other in parallel on the substrate on which the pattern display portion is established, the conductive bases having at least one pair of position-setting holes oriented toward the substrate; at least one pair of supporters each of which includes a fixing portion having at least one pair of position-setting holes corresponding to the position-setting holes of the bases, and a supporting portion extending from the fixing portion to a predetermined height, and each of which has a slot as one of the position-setting holes, the slot being arranged parallel to the base; filaments welded to the supporting portion and established at a predetermined height above the substrate: and a grid positioned between the filaments and the substrate for controlling the flow of thermal electrons from the filaments.

BRIEF DESCRIPTION 0F THE DRAWINGS

These and other objects, features, aspects and advantages of the present invention will become more apparent from the following detailed description of the present invention when taken in conjunction with the accompanying drawings, in which.

DETAILED DESCRIPTION OF THE INVENTION

Figure 1:
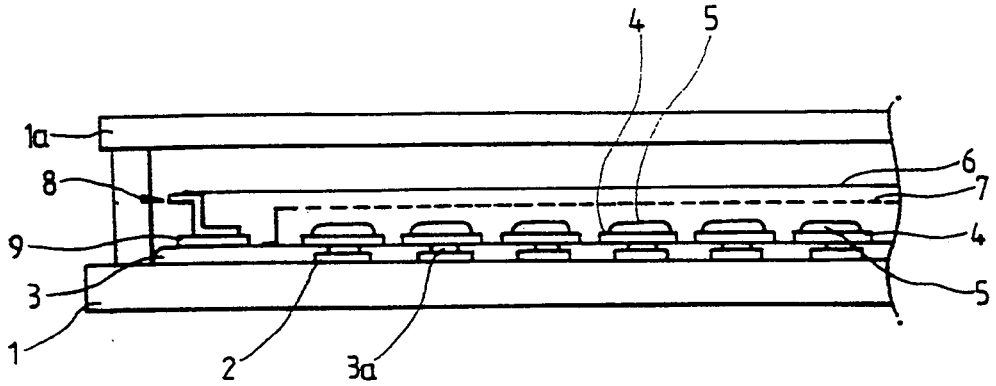
FIG. 1 (PRIOR ART)
FIG. 1 is a schematic sectional view of the conventional fluorescent display device.
Figure 2:
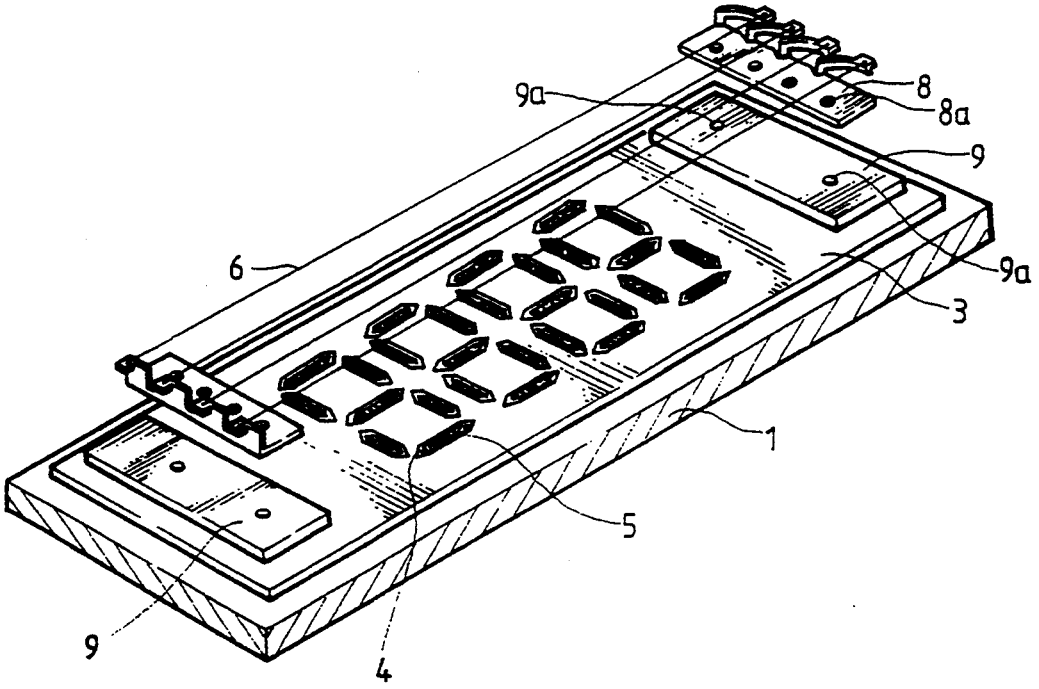
FIG.2 (PRIOR ART)
FIG. 2 is a schematically drawn perspective view of the conventional fluorescent display device.
Figure 3:
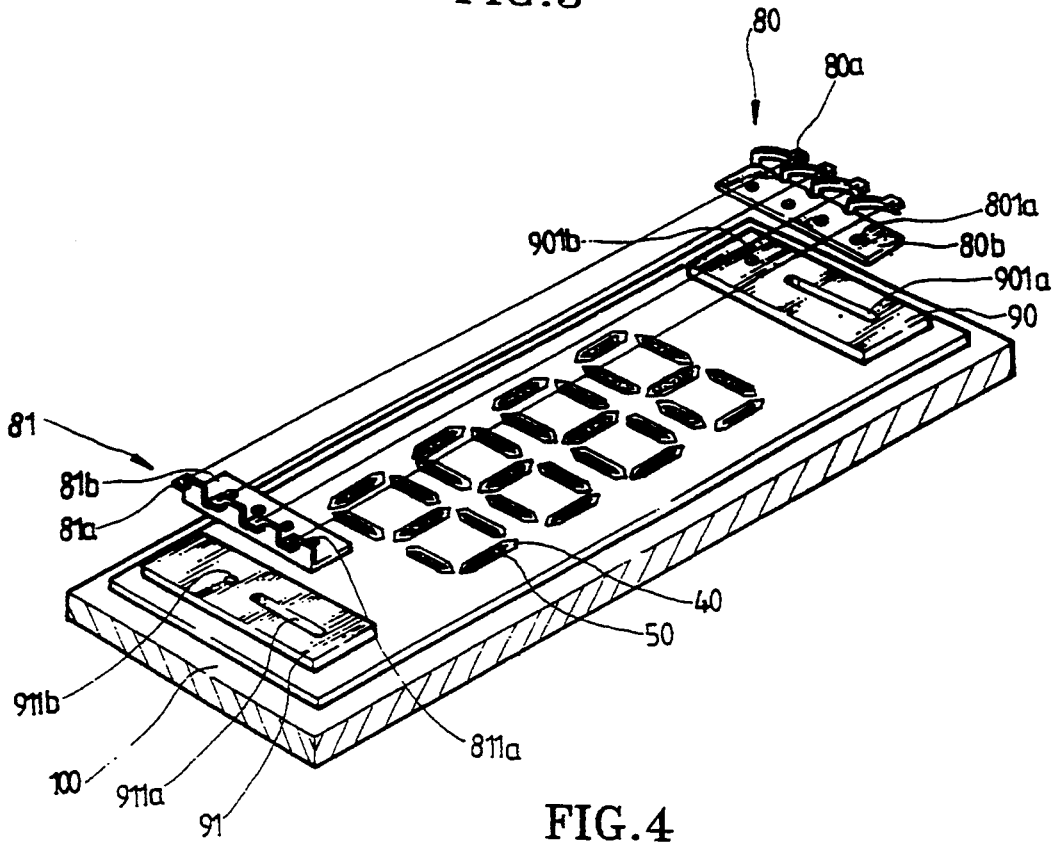
FIG. 3 is a schematically drawn perspective view of a fluorescent display device according to the present invention.

Referring to FIG. 3, a pattern display portion having a general type of structure and capable of displaying an image is established on a substrate 100. The pattern display portion includes a fluorescent layer 50 emitting visible light due to the impact thermal electrons and a conductive segment layer 40 on which fluorescent layer 50 is deposited and which is kept at positive voltage to attract thermal electrons. Similar to FIG. 1, the pattern display portion is enclosed by an insulation layer. Also, provided below the insulation layer are the signal line which is electrically connecting to conductive segment layer 40, and the insulation layer has a plurality of through-holes for electrical conduction between the segment layer and signal line.

Filaments 60 emitting thermal electrons arranged above the pattern display portion, and a control grid (not represented) for controlling the flow of thermal electrons is established in the space between filaments 60 and the pattern display portion Filaments 60 are supported by two opposing supporters 80 and 81. Supporters 80 and 81 have welding portions 80*a* and 81*a* to which filaments 60 are welded and fixing portions 80*b* and 81*b* which are fixed onto the substrate. Supporters 80 and 81 are constructed the same as the conventional art, and are welded onto bases 90 and 91 rigidly mounted on substrate 10. Looking at supporters 80 and 81 and bases 90 and 91 in detail, fixing portions 80*b* and 81*b* of the supporters 80 and 81 are furnished with a plurality of welding-position-setting holes 801*a* and 811*a* at predetermined intervals. Further, bases 90 and 91 are furnished with a plurality of position-setting holes 901*a*, 90l*b*, 911*a* and 911*b* corresponding to the plurality of welding-position-setting holes 801*a* and 811*a* of supporters 80 and 81.

Figure 4:
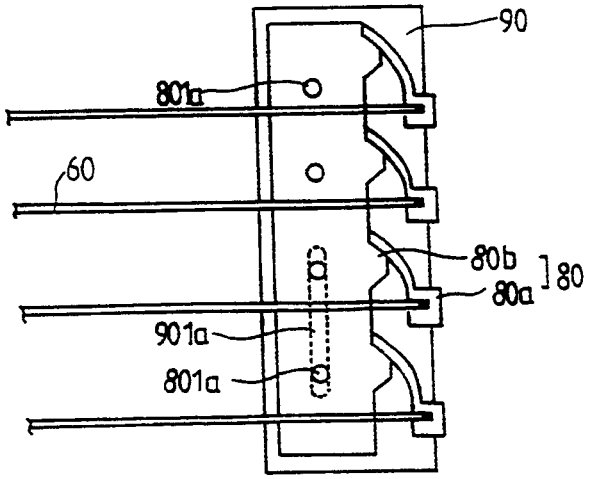
FIG. 4 is a partial plan view of the fluorescent display device according to the present invention as shown in FIG.3, with the interlocking of a supporter welded to filaments and a base for fixing the supporter onto the substrate.

Referring to FIG.4, of the welding-position-setting holes of bases 90 and 91, first position-setting holes 901*b* and 911*b* are circular, and in contrast, second position-setting holes 901*a* and 911*a* are slot-shaped along direction parallel to the bases. Slot-shaped second position-setting holes 901*a* and 911*a* enable the bases to be used even in the case where the intervals between position-setting holes of supporters 80 and 81 are modified by design. The second position-setting holes are extend towards the first position-setting holes as described above, perpendicular to the placement of the filaments. At least one slot-shaped second position-setting hole should be present in the supporter, and if necessary, a plurality of second position-setting holes can be present.

In the fluorescent display device of the present invention as described above, the parallelism of the two opposing bases onto which supporters are secured affects on whether the two supporters are in the exact parallel, and therefore the two opposing bases should be carefully arranged in parallel even when fixing the bases on the substrate. Furthermore, when welding the supporters to the bases, the supporters should also be held in place parallel to each other. Accordingly, since in the fluorescent display device of the invention the circular position-setting holes on the bases match the corresponding circular position-setting holes on the supporters, they can determine the first fixing position of supporters on the bases. Also, the slot-shaped position-setting holes of the bases match the corresponding circular position-setting holes of the supporters, to prevent the supporters from rotating with respect to the bases, so that the supporters can be placed parallel to the bases.

In accordance with the bases having the position-setting holes, the circular position-setting holes and slot-shaped position-setting holes are for matching the positions of the bases and supporters so as to place the two opposing supporters parallel to each other. Moreover, the circular position-setting holes are for determining the absolute fixing positions of supporters with respect to the bases, as described above.

In consideration of the bases and supporters described above, it can be expected that the slot-shaped position-setting holes are provided on the supporters so that the supporters can be widely used. On the other hand, the slot-shaped position-setting holes can be present on both the bases and supporters. In this case, the circular position-setting holes and other position-setting holes can be formed symmetrically located on bases and supporters, respectively.

The fluorescent display devices which are described above can be converted and modified in various forms. Also, it is clearly understood that, for a supporter on which position-setting holes are arranged at different intervals, any structure having at least. one circular position-setting hole and at least one slot-shaped position-setting hole in no way departs from the scope of the invention.

What is claimed is:

1. A fluorescent display device comprising:
a substrate;
a predetermined pattern display portion on said substrate, said pattern display portion including a fluorescent layer, a segment layer, and a signal line;
at least one pair of conductive bases separated from each other by a predetermined interval, facing and parallel to each other on said substrate, each of said conductive bases having at least one pair of position-setting holes perpendicular to said substrate;
at least one pair of supporters, each supporter being attached to one of said bases and including a fixing portion having at least one pair of position-setting holes corresponding to the position-setting holes of said base, and a supporting portion extending from said fixing portion, at least one of the position-setting holes of said base being a slot aligned parallel to said base to which a supporter is attached;
filaments welded to said supporting portions of said supporters and spaced from said substrate; and
a grid positioned between said filaments and said substrate for controlling flow of thermal electrons escaping from said filaments.

2. The fluorescent display of claim 1 wherein the position-setting holes of said supporters are aligned with the position-setting holes of the bases to which the supporters are attached.

3. The fluorescent display device of claim 2 wherein the position-setting holes in said supporters are circular and one of the position-setting holes in each of the bases is circular.

4. A fluorescent display device comprising:
a substrate;
a predetermined pattern display portion on said substrate, said pattern display portion including a fluorescent layer, a segment layer, and a signal line;
at least one pair of conductive bases separated from each other by a predetermined interval, facing and parallel to each other on said substrate, each of said conductive bases having at least one pair of position-setting holes perpendicular to said substrate;
at least one pair of supporters, each supporter being attached to one of said bases and including a fixing portion having at least one pair of position-setting holes corresponding to the position-setting holes of said base, and a supporting portion extending from said fixing portion, at least one of the position-setting holes of each base being a slot;
filaments welded to said supporting portions of said supporters, extending between said supporters, and spaced from said substrate, the slots being transverse to said filaments; and a grid positioned between said filaments and said substrate for controlling flow of thermal electrons escaping from said filaments.

5. The fluorescent display of claim 4 wherein the position-setting holes of said supporters are aligned with the position-setting holes of the bases to which the supporters are attached.

6. The fluorescent display device of claim 5 wherein the position-setting holes in said supporters are circular and one of the position-setting holes in each of the bases is circular.

* * * * *